US011697864B2

(12) United States Patent
Kwak et al.

(10) Patent No.: US 11,697,864 B2
(45) Date of Patent: Jul. 11, 2023

(54) COPPER ALLOY STRIP HAVING HIGH HEAT RESISTANCE AND THERMAL DISSIPATION PROPERTIES

(71) Applicant: Poongsan Corporation, Pyeongtaek-Si (KR)

(72) Inventors: Won Shin Kwak, Ulsan (KR); Min Jae Jeong, Ulsan (KR); Hye Min Hong, Ulsan (KR)

(73) Assignee: Poongsan Corporation, Pyeongtaek-si (KR)

( * ) Notice: Subject to any disclaimer, the term of this patent is extended or adjusted under 35 U.S.C. 154(b) by 988 days.

(21) Appl. No.: 16/327,484

(22) PCT Filed: Aug. 24, 2018

(86) PCT No.: PCT/KR2018/009778
§ 371 (c)(1),
(2) Date: Feb. 22, 2019

(87) PCT Pub. No.: WO2019/078474
PCT Pub. Date: Apr. 25, 2019

(65) Prior Publication Data

US 2021/0363611 A1 Nov. 25, 2021

(30) Foreign Application Priority Data

Oct. 18, 2017 (KR) ..... 10-2017-0135024

(51) Int. Cl.
*C22C 9/00* (2006.01)
*C21D 8/02* (2006.01)
*C21D 9/46* (2006.01)
*C22C 1/02* (2006.01)

(52) U.S. Cl.
CPC ..... *C22C 9/00* (2013.01); *C21D 8/0226* (2013.01); *C21D 8/0236* (2013.01); *C21D 9/46* (2013.01); *C22C 1/02* (2013.01)

(58) Field of Classification Search
CPC ..... C22C 9/00; C22C 1/02; C21D 8/0226; C21D 8/0236; C21D 9/46; C22F 1/08; B21B 2003/005
USPC ..... 420/496
See application file for complete search history.

(56) References Cited

U.S. PATENT DOCUMENTS 5,486,244 A * 1/1996 Caron ..... C22F 1/08 148/554
2008/0056930 A1 3/2008 Ito et al.
2010/0170595 A1 7/2010 Kaneko et al.
2011/0186192 A1* 8/2011 Mihara ..... C22F 1/08 148/414
2014/0305551 A1 10/2014 Park
2015/0376755 A1* 12/2015 Kim ..... C22C 9/00 148/411

FOREIGN PATENT DOCUMENTS

| | | | |
|---|---|---|---|
| CN | 1442500 | A | 9/2003 |
| CN | 102212712 | A | 10/2011 |
| CN | 105568047 | A | 5/2016 |
| CN | 105568047 | A | 5/2016 |
| CN | 106350698 | A | 1/2017 |
| CN | 106350698 | A | 3/2018 |
| DE | 102014010235 | A1 | 1/2016 |
| EP | 2377959 | A1 | 10/2011 |
| JP | S62-130247 | A | 6/1987 |
| JP | S62-182240 | A | 8/1987 |
| JP | S63-93835 | A | 4/1988 |
| JP | S63-125628 | A | 5/1988 |
| JP | 10168532 | A | 6/1998 |
| JP | 2008056977 | A | 3/2008 |
| JP | 2008266787 | A | 11/2008 |
| JP | 2009167450 | A | 7/2009 |
| JP | 2009242814 | A | 10/2009 |
| JP | 2012077362 | A | 4/2012 |
| JP | 2014189804 | A | 10/2014 |
| TW | 201708550 | A | 3/2017 |
| TW | 201708550 | A | 3/2017 |
| TW | 201736613 | A | 10/2017 |
| TW | 201736613 | A | 10/2017 |

OTHER PUBLICATIONS

Taiwanese Office Action for Application No. 107131726, dated Feb. 27, 2019, 5 pages.
Korean Intellectual Property Office, International Search Report, dated Nov. 28, 2018, 9 pages.
Chinese Office Action (with English translation) for Application No. 2018800003546.9 dated Feb. 24, 2021, 6 pages.
Japan Patent Office, Notice of Reasons for Refusal for Patent Application No. 2019-512913, dated May 29, 2020, 7 pages.
Taiwanese Office Action for Application No. 107131726, dated Feb. 27, 2019, 5 pages (with Translation).
Taiwan Intellectual Property Office, Office action, dated Feb. 27, 2019, 5 pages.
China National Intellectual Property Administration, First Office Action of Chinese Patent Application No. 201880003546.9, dated Jun. 17, 2020.
International Searching Authority, Written Opinion of the International Searching Authority, dated Nov. 28, 2018, 14 pages.

* cited by examiner

*Primary Examiner* — Brian D Walck
*Assistant Examiner* — Danielle Carda
(74) *Attorney, Agent, or Firm* — Loeb Loeb LLP

(57) ABSTRACT

Disclosed are a copper alloy strip having high heat resistance and thermal dissipation properties which is suitable for a material for shield cans to solve heating of mobile devices, a material for vehicles and semiconductor lead frames, and a material for electrical and electronic parts, such as connectors, relays, switches, etc., widely used in industries including vehicles, and a method of preparing the same.

7 Claims, 3 Drawing Sheets

| wt% | Cu | Cr | Co | Si |
|---|---|---|---|---|
| Coarse | 8.0 | 79.29 | 1.08 | 11.63 |

| wt% | Cu | Cr | Co | Si |
|---|---|---|---|---|
| Fine | 4.36 | 73.74 | 11.06 | 9.84 |

COPPER ALLOY STRIP HAVING HIGH HEAT RESISTANCE AND THERMAL DISSIPATION PROPERTIES

CROSS REFERENCE OF RELATED APPLICATIONS

The present application is a US national stage of a PCT international application, Serial no. PCT/KR2018/009778, filed on Aug. 24, 2018, which claims the priority of Korean patent application No. 10-2017-0135024, filed with KIPO of Republic of Korea on Oct. 18, 2017, the entire content of these applications are incorporated into the present application by reference herein.

FIELD OF THE INVENTION

The present invention relates to a copper alloy strip having high heat resistance and thermal dissipation properties which is suitable for a material for shield cans to solve heating of mobile devices, a material for vehicles and semiconductor lead frames, and a material for electrical and electronic parts, such as connectors, relays, switches, etc., widely used in industries including vehicles, and a method of preparing the same.

BACKGROUND OF THE INVENTION

As mobile products are developed towards high performance and miniaturization, materials which effectively treat heat generated from the insides of the products, i.e., have excellent thermal dissipation properties, as well as have high strength are required. When a thermal dissipating material is used as a case or can type part rather than a thin plate type part, such as a cooling fin, which is conventionally used, heat is structurally accumulated therein and thus, better thermal dissipation properties are required. The reason for this is that the case or can type part should protect main parts provided therein from external impact (strength) and effectively dissipate heat generated from the inside of the case or can type part and thus protect the main parts from internal heat (heat dissipation).

Recently, as electric vehicles are rapidly increased and vetronics in internal combustion engine vehicles is accelerated, development of electrical and electronic parts of vehicles to cope with high pressure and high current is required, and used materials require not only high conductivity but also durability to resistance heating with respect to high pressure and high current and heat generated due to extreme environments, such as a vehicle engine compartment. Therefore, in a copper alloy material for electrical and electronic parts of vehicles, a reference value of thermal conductivity should be gradually raised according to technical development.

Therefore, the copper alloy material for electrical and electronic parts requires tensile strength of 350 MPa or more and thermal conductivity of 200 W/m·K or more, and these reference values tend to be gradually raised according to technical development and miniaturization of parts.

Further, if the copper alloy material for electrical and electronic parts is applied to processed products, such as cases, cans, connectors, relays, etc., the copper alloy material for electrical and electronic parts requires stable power supply and transfer of heat and electrical signals in addition to mechanical strength, and in order to prevent cracks due to processing, requires excellent bendability.

That is, the copper alloy material for electrical and electronic parts requires strength of a medium level or more, high thermal dissipation and conductivity, excellent heat resistance and excellent bendability. Among conventional existing copper alloys, as representative copper alloys being close to satisfying these characteristics, there are (1) a Corson-based alloy having excellent strength and heat resistance and (2) a copper-chrome (Cu—Cr)-based alloy having excellent balance between strength and conductivity.

Korean Patent Application Publication No. 10-2011-0088595 (Related Document 1) disclosing addition of cobalt to a Corson-based (Cu—Ni—Si) alloy composition describes a method of manufacturing, as a copper alloy having excellent strength, conductivity and fatigue resistance, a copper alloy for electronic materials including 1.0-2.5% by mass of Ni, 0.5-2.5% by mass of Co, 0.3-1.2% by mass of Si and the balance of Cu and inevitable impurities, a number density of particles having particle sizes of 5 nm to 50 nm is $1\times10^{12}$-$1\times10^{14}$/mm$^3$, among second phase particles precipitated from a parent phase, and a ratio of a number density of particles having particle sizes of 5 nm or more and less than 20 nm to a number density of particles having particle sizes of 20 nm to 50 nm is 3-6, and the method includes executing solution treatment by heating a material to a temperature of 950° C. to 1,050° C. after hot rolling. According to the aforementioned Patent Document, the copper alloy may secure yield strength of about 850 MPa and electrical conductivity of about 45% IACS, but the total content of nickel and cobalt is 3.0% by mass and thus, in order to exhibit effects of adding nickel, cobalt and silicon, solution treatment at a temperature of 950° C.-1,050° C. is required in addition to hot rolling. Such solution treatment is additionally executed, thus complicating a manufacturing process and causing rise in manufacturing costs. Further, the Corson-based copper alloy according to the Patent Document has electrical conductivity of 45% IACS and thus does not reach a recently required electrical conductivity level, i.e., electrical conductivity of 75% IACS or more.

Further, Korean Patent Application Publication No. 10-2010-0113644 (Related Document 2) discloses, as a high-strength and high-conductivity Corson-based alloy having improved characteristics by adding chrome and cobalt, a copper alloy for electronic materials including 1.0-4.5% by mass of Ni, 0.50-1.2% by mass of Si, 0.1-2.5% by mass of Co, 0.003-0.3% by mass of Cr and the balance of Cu and inevitable impurities, amass concentration ratio ([Ni+Co]/Si) of a total mass of Ni and Co to a mass of Si is 4-5 ($4\leq[Ni+Co]Si\leq5$), in a Cr—Si compound having dispersed particles having a size of 0.1 μm-5 μm, a ratio of atomic percentage of Cr to Si in the dispersed particles is 1-5, and a dispersion density of the Cr—Si compound exceeds $1\times10^4$/mm$^2$ and is $1\times10^6$ mm$^2$ or less. The alloy according to this Patent Document may secure yield strength of about 800 MPa and electrical conductivity of about 45% IACS, similarly to Related Document 1, and in order to suppress reduction in electrical conductivity, chrome is added, reacts with excessively added silicon and thus generates a compound in a matrix so as to promote high conductivity. However, in this Patent Document also, in order to exhibit characteristics of added elements, i.e., nickel, cobalt and silicon, solution treatment is required in addition to hot rolling.

Korean Patent Application Publication No. 10-2017-0018881 (Related Document 3) discloses, as copper-chrome alloy, a copper alloy strip including 0.10-0.50% by mass of Cr, 0.01-0.50% by mass of Mg, one selected from the group consisting of a first additive element group including 0.00-

0.20% by mass of at least one of Zr or Ti and a second additive element group consisting of 0.00-0.50% by mass of at least one of Zn, Fe, Sn, Ag, Si or Ni, and the balance of Cu and inevitable impurities, in which crystal grains having a particle size of 30 μm or less have an area ratio of 30-70% in a cross-section vertical to a width direction TD of the strip. According to this Patent Document, when the copper alloy strip is left at a temperature of 150° C. for 1,000 hours, a stress relaxation rate of the copper alloy strip is excellent, i.e., 20% or less, and when the copper alloy strip is bent at an angle of 90°, an R/t ratio is 1.0 and thus no cracks occur, but the copper alloy strip secures relatively low tensile strength of 430 MPa. Further, the copper alloy strip includes magnesium having high oxidizing properties as a main component and includes zirconium (Zr) and titanium (Ti) having very high oxidizing properties in the additive group, and thus frequently causes generation of air bubbles during casting and it is difficult to acquire a good ingot. In order to solve such problems, an expensive vacuum or semi-vacuum casting furnace is used or a high-cost method, such as wire-feeding, which prevents oxidation of additive elements and increases residues thereof in a product, is required during casting when the strip is case using a general atmospheric furnace, and a difficulty in molten alloy treatment is predicted.

SUMMARY OF THE INVENTION

Object to be Solved

An object of the present invention is to provide a copper alloy strip for electrical and electronic parts of apparatuses including vehicles, having excellent heat resistance and thermal dissipation properties, high strength of a level required by electrical and electronic parts including vehicles, and excellent bendability, and a method of preparing the same.

Means for Solving Object

To achieve these objects and other advantages and in accordance with the purpose of the invention, as embodied and broadly described herein, a copper alloy strip for electrical and electronic parts includes 0.20-0.40% by mass of chrome (Cr), 0.01-0.15% by mass of cobalt (Co), and the balance of copper (Cu) and inevitable impurities, and optionally 0.00-0.15% by mass of at least one selected from the additive element group consisting of silicon (Si), magnesium (Mg) and tin (Sn). The additive element group includes selective elements. The copper alloy strip has a softening resistant temperature of 450° C. or higher and thermal conductivity of 280 W/m·K or more.

A cobalt content may be in a range of 0.05-0.15% by mass. A total content of the at least one selected from the additive element group may be in a range of 0.05-0.15% by mass. The softening resistant temperature of the copper alloy strip may be 500° C. or higher. The thermal conductivity of the copper alloy strip may be 300 W/m·K or more. An R/t ratio of the copper alloy strip at which no cracks occur during bending at an angle of 90° may be 1.0 or less. The R/t ratio of the copper alloy strip at which no cracks occur during bending at the angle of 90° may be 0.5 or less. Relations between thermal conductivity κ (W/m·K) and electrical conductivity σ ($(\Omega m)^{-1}$) of the copper alloy strip may satisfy Equation $\kappa=2.24(\pm0.02)\times10^{-8}\ W\Omega K^{-2}\times1/\Omega m\times293.15(K)$.

In accordance with another aspect, a method of preparing a copper alloy strip for electrical and electronic parts includes melting elements based on the composition of the above-described copper alloy strip, in a melting furnace, to cast an ingot; homogenization heat treating the acquired ingot at a temperature of 850-1,000° C. for 1-4 hours; hot rolling the obtained product from the previous step at a working ratio of 40-95%; water quenching the obtained product from the previous step simultaneously with completion of the hot rolling to solution treat at a material surface treatment of 600° C. or higher; cold rolling the obtained product from the previous step at a working ratio of 87-98%; precipitation heat treating the obtained product from the previous step at a temperature of 430-520° C. for 1-10 hours; and final cold rolling the obtained product from the previous step at a working ratio of 10-70% to produce a finished product of the copper alloy strip, wherein an R/t ratio of the finished product of the copper alloy strip at which no cracks occur during bending at an angle of 90° is 1.0 or less.

The method may further include, after the precipitation heat treatment, cold rolling the obtained product from the previous step at a working ratio of 30-90% and intermediate heat treating the obtained product from the previous step at a temperature of 550-700° C. for 10-100 seconds, prior to the final cold rolling. The R/t ratio of the finished product of the copper alloy strip at which no cracks occur during bending at the angle of 90° may be 0.5 or less.

Effects of the Invention

A copper alloy strip in accordance with the present invention has high heat resistance and thermal dissipation properties and excellent strength and bendability. The copper alloy strip in accordance with the present invention may be not only used in conventional electrical and electronic parts or plat type parts, such as a cooling fin, but also used as a material for cans or cases, such as a shield can used for shielding electromagnetic waves and for dissipating heat in parts for various mobile and electronic devices. Further, the copper alloy strip may provide high reliability in strength and conductivity in products, such as connectors, relays, switches, etc., which are exposed to high-temperature conditions or requires stress maintenance for a long time. The copper alloy strip is applicable to various other fields due to excellent heat resistance, thermal dissipation, strength and bendability thereof, in addition to the above-described fields.

DETAILED DESCRIPTION

Figure 1:
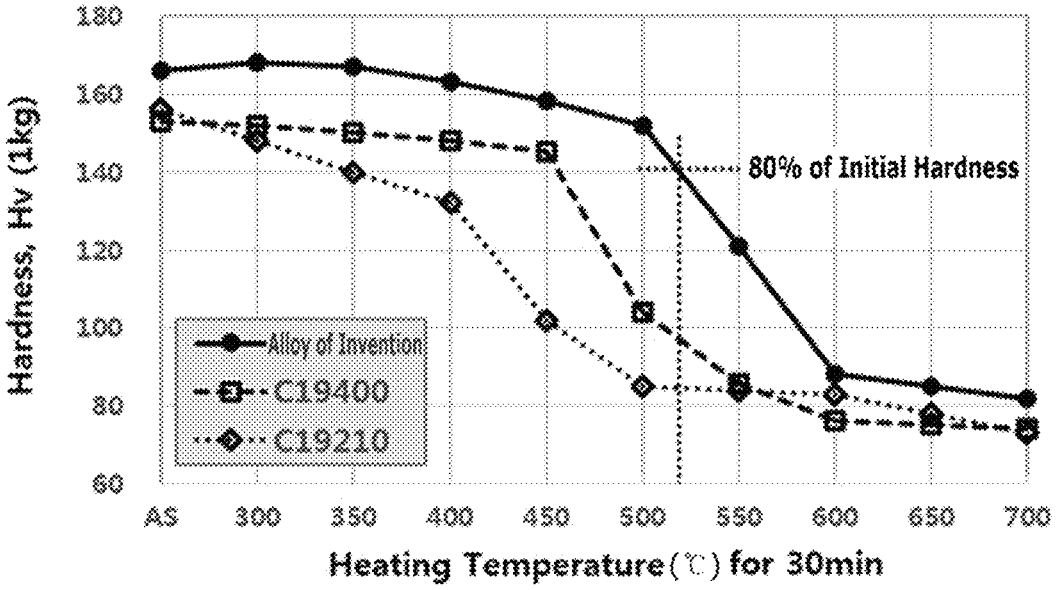
FIG. 1 is a graph illustrating softening resistant temperatures of a specimen of a copper alloy strip in accordance with the present invention (Example 11) and a conventional copper alloy.

The present invention provides a copper alloy strip for electrical and electronic parts having strength of a medium level or more, high heat resistance, high thermal dissipation and excellent bendability.

The copper alloy strip in accordance with the present invention includes 0.20-0.40% by mass of chrome (Cr), 0.01-0.15% by mass of cobalt (Co), 0.00-0.15% by mass of at least one selected from the additive element group consisting of silicon (Si), magnesium (Mg) and tin (Sn), and the balance of copper (Cu) and inevitable impurities. The additive element group consists of selective elements.

Further, the copper alloy strip may include 0.05-0.15% by mass of cobalt (Co). The copper alloy strip may include 0.05-0.15% by mass of the at least one selected from the additive element group.

Hereinafter, a component composition of the copper alloy strip in accordance with the present invention will be described.

(1) Cr: 0.20-0.40% by Mass

In the copper alloy strip in accordance with the present invention, Cr is precipitated as metallic Cr or a compound with Si and contributes to improvement in strength and softening resistance. If a Cr content is less than 0.20% by mass, slight strength improvement effects are exhibited but such a Cr content is insufficient to acquire target physical properties of the copper alloy strip of the present invention. On the other hand, if the Cr content exceeds 0.40% by mass, many coarse precipitates are generated and may exert a negative influence on bendability and characteristic improvement effects in proportion to the amount of added Cr may not be acquired. Therefore, the Cr content is in the range of 0.20 to 0.40% by mass.

(2) Co: 0.01-0.15% by Mass

In the copper alloy strip in accordance with the present invention, Co is precipitated as metallic Co or compounds with Si, Mg and/or Sn and contributes to improvement in strength and softening resistance. If a Co content is less than 0.01% by mass, softening resistance improvement by addition of Co is insignificant, and if the Co content exceeds 0.15% by mass, softening resistance is increased but it is difficult to secure bendability and conductivity, or, even if bendability and conductivity are secured by increasing temperature and time taken to execute precipitation heat treatment, raw material costs are increased and such an excessively large Co content is not recommended (at the present, the price of Co is about 10 times higher than the price of Cu). Therefore, the Co content is in the range of 0.01 to 0.15% by mass. Particularly, if the Co content is 0.05% by mass or more and the total content of at least one selected from the additive element group is 0.05% by mass or more, softening resistant characteristics are greatly improved, as compared to conventional alloys, and thus the copper alloy strip in accordance with the present invention satisfies a softening temperature of 500° C. or higher.

(3) Additive Element Group (Si, Mg, Sn): Total 0.00-0.15% by Mass

The copper alloy strip in accordance with the present invention may include at least one selected from the group consisting of Si, Mg and Sn. These selectively added elements are referred to as being included in the additive element group and it is known that the elements included in the additive element group form compounds with Co. If these elements are individually added, the elements contribute to improvement in strength and softening resistance but, if two or more of the elements are added, such improvement effects are further enhanced in proportion to the total content of the elements. The reason for this is that the additive elements react with chrome and cobalt, i.e., component elements of the copper alloy strip of the present invention, generate compounds, for example, Cr—Si, Co—Si, Co—Sn, Co—Mg, etc., and thus increase strength of the copper alloy strip, and reduce the content of the remainder of the elements, which do not generate the compounds and form a solid solution in a matrix and thus increase conductivity and maximize precipitation hardening effects.

In the present invention, the total content of the at least one selected from the additive element group is 0.00-0.15% by mass. If the content of the at least one selected from the additive element group is 0.15% by mass or less, the finally acquired copper alloy strip satisfies a softening resistant temperature of 450° C. or higher and thermal conductivity of 280 W/m·K or more, and if the Co content is 0.05% by mass or more and the total content of the at least one selected from the additive element group is 0.05% by mass, softening resistance characteristics of the acquired copper alloy are remarkably improved, as compared to conventional alloys, and thus the acquired copper alloy strip satisfies a softening resistant temperature of 500° C. or higher and thermal conductivity of 280 W/m·K or more.

1) Si

In the additive element group, Si is precipitated as compounds with Cr, Co and/or Mg and thus contributes to improvement in strength and softening resistance. If an Si content exceeds 0.15% by mass, it is difficult to secure bendability and conductivity. The Si content may be 0.01-0.15% by mass. If Si alone is added, the Si content may be 0.02 to 0.15% by mass.

2) Mg

In the additive element group, Mg forms a solid solution in an alloy or is precipitated as compounds with Co, Si and/or Sn and thus contributes to improvement in strength and softening resistance. If an Mg content exceeds 0.15% by mass, it is difficult to secure bendability and conductivity and it is difficult to control the residual amount of Mg due to oxidation during casting. The Mg content may be 0.01-0.15% by mass. If Mg alone is added, the Mg content may be 0.02 to 0.15% by mass.

3) Sn

In the additive element group, Sn forms a solid solution in an alloy or is precipitated as compounds with Co and/or Mg and thus contributes to improvement in strength and softening resistance. If an Sn content exceeds 0.15% by mass, it is difficult to secure bendability and conductivity. The Sn content may be 0.01-0.15% by mass. If Sn alone is added, the Sn content may be 0.02 to 0.15% by mass.

(4) Remaining Amount of Copper (Cu) and Other Inevitable Impurities

The copper alloy strip in accordance with the present invention may include the balance of copper and other inevitable impurities.

However, in the composition of the copper alloy strip in accordance with the present invention, iron (Fe) and nickel (Ni), which are general alloy elements, do not exhibit strengthening effects under conditions in which conductivity properties are maintained and may thus maintain a content of 0.1% by mass or less.

In the composition of the copper alloy strip in accordance with the present invention, aluminum (Al) and manganese (Mn) have a difficulty in component maintenance in a molten alloy and do not exhibit excellent effects in proportion to the addition amount thereof and may thus maintain a content of 0.1% by mass or less.

Further, although phosphorus (P) is generally effective in removal of oxygen from the molten alloy, in the copper alloy strip in accordance with the present invention, phosphorus (P) has some effects of raising clearness in the molten alloy, such as reduction in formation of Cr oxides through removal of oxygen from the molten alloy, but reduces precipitation ability of chrome (Cr) compounds, obstructs increase in conductivity and strength and may thus maintain a content of 0.01% by mass or less. Since electrical conductivity is actually raised by 1% IACS when 0.01% by mass of P is added under the same conditions, the 0.01% by mass or less of P does not have a decisive effect on conductivity of the copper alloy strip in accordance with the present invention.

[Characteristics of Copper Alloy Strip in Accordance with the Invention]

(1) Softening Resistance

The copper alloy strip in accordance with the present invention exhibits high softening resistance. Softening resistance is expressed as a softening resistant temperature. The softening resistant temperature means a temperature value which, when values of hardness of a copper alloy strip prepared as a finished product, changed after heat treatment at respective temperatures for 30 minutes are measured, corresponds to 80% of an initial hardness value (prior to heat treatment). Therefore, through softening resistant temperature analysis, how much a material maintains initial hardness thereof with respect to heat generated due to service conditions and heat applied from the outside in high-temperature environments may be evaluated. A material having a high softening resistant temperature is not easily degraded at a high temperature and in high-temperature environments and has excellent ability of maintaining initial strength thereof, thus being capable of providing high reliability in mechanical functions.

After heat treatment of a specimen is executed respectively at temperatures at intervals of 50° C., hardness changes of the specimen are measured, a graph of a broken line in which the Y-axis represents hardness and the X-axis represents temperature is drawn, and a temperature value intersecting a point corresponding to 80% of an initial hardness value is calculated as the softening resistant temperature.

The softening resistant temperature of the copper alloy strip in accordance with the present invention is 450° C. or higher, and particularly, 500° C. or higher. With reference to FIG. 1, it may be confirmed that the softening resistant temperature of the copper alloy strip in accordance with the present invention is higher than that of an alloy C19400 or an alloy 19210 having similar strength and conductivity by 100° C. or higher.

(2) Thermal Conductivity

The copper alloy strip in accordance with the present invention exhibits excellent thermal conductivity. Thermal conductivity means a property in which a material transfers heat, and a material having high thermal conductivity is referred to as a high thermal dissipating material.

Thermal conductivity has a proportional relationship with electrical conductivity according to the Wiedemann-Franz law, and the Lorenz number representing a proportional degree therebetween is finely varied according to kinds of materials, components of an alloy and contents thereof. A relationship between thermal conductivity and electrical conductivity of a general metal material satisfies Equation $\kappa/\sigma=LT$. Here, $\kappa$ represents thermal conductivity, a unit of which is W/m·K, L represents the Lorenz number, a unit of which is $W\Omega K^{-2}$, T represents an absolute temperature, a unit of which is K, and a represents electrical conductivity, a unit of which is $(\Omega m)^{-1}$.

A relationship between thermal conductivity and electrical conductivity of a copper alloy satisfies the mathematical expression of the Wiedemann-Franz law, namely, Equation $\kappa/\sigma=LT$, i.e., $\kappa=L\sigma T$, and the Lorenz number L of the copper alloy in accordance with the present invention is $2.24(\pm0.02)\times10^{-8}$ $W\Omega K^{-2}$. That is, in the mathematical expression between thermal conductivity $\kappa$ and electrical conductivity $\sigma$, Equation $\kappa=2.24(\pm0.02)\times10^{-8}$ $W\Omega K^{-2}\times1/\Omega m\times293.15(K)$ is satisfied. Here, a value of electrical conductivity $1/\Omega m$ may be calculated by Equation $5.8001\times10^{7}\times$% IACS/100, and a value of 293.15(K) means 20° C.

In the mathematical expression according to the Wiedemann-Franz law, the Lorenz number K of the copper alloy strip in accordance with the present invention is $2.24(\pm0.02)\times10^{-8}$ $W\Omega K^{-2}$, i.e., $2.24(\pm0.02)\times0.00000001$ $W\Omega K^{-2}$. Therefore, after electrical conductivity of the copper alloy strip in accordance with the present invention is simply measured, thermal conductivity of the copper alloy strip may be calculated by putting the deduced Lorenz number into the mathematical expression, and a reliability range of thermal conductivity of the copper alloy strip is excellent, i.e., about ±0.9%.

(3) Strength

The copper alloy strip in accordance with the present invention has sufficient strength which is applicable to a material for electrical and electronic parts and vehicle parts. In this regard, as compared to physical properties of alloys C19400 (Cu—Fe—P—Zn-based), C19210 (Cu—Fe—P-based) and C26800 (Cu—Zn-based) which are used now for the above-described purpose, it may be understood that the copper alloy strip in accordance with the present invention requires tensile strength of 350 to 600 MPa. Based on Examples of the copper alloy strip in accordance with the present invention, the copper alloy strip satisfies the corresponding required strength.

(4) Bendability

The copper alloy strip in accordance with the present invention requires different levels of bendability according to application fields. For example, a part processed by stamping or etching, such as a material for lead frames, requires strength, conductivity and high surface quality rather than bendability, but a part bent by pressing, such as a connector, should satisfy bendability together with strength and conductivity. The copper alloy strip in accordance with the present invention has an R/t ratio of 1.0 or less at which no cracks occur in a bending test at an angle of 90°, and may satisfy an R/t ratio of 0.5 or less by changing precipitation heat treatment conditions, as needed.

[Method of Preparing Copper Alloy Strip in Accordance with the Invention]

In a method of preparing the copper alloy strip in accordance with the present invention, component elements according to the above-described composition of the copper alloy strip are melted in a melting furnace to cast an ingot (melting and casting step); the acquired ingot is subjected to homogenization heat treatment at a temperature of 850-1,000° C. for 1-4 hours (homogenization heat treatment step); the obtained product from the previous step is subjected to hot rolling at a working ratio of 40-95% (hot rolling step); simultaneously with completion of hot rolling, the obtained product from the previous step is subjected to water quenching to solution treat solute elements (solution treatment step) so as to suppress precipitation of solute elements. Here, solution treatment is executed through a process in which the solute elements are supersaturated and thus form a solid solution by water quenching of a material in a cooling process after completion of hot rolling, and thus a heating process for solution treatment, as in Related Documents 1 and 2, is not additionally carried out. Therefore, as the surface temperature of the material prior to water quenching is increased, solution treatment effects are increased, and the surface temperature of the material prior to water quenching may be 600° C. or higher, particularly 700° C. or higher.

Thereafter, after precipitation driving force is increased through cold rolling at a working ratio of 87-98% (cold rolling step), the product from the previous step is subjected to precipitation heat treating at a temperature of 430-520° C. for 1-10 hours (precipitation heat treatment step).

As needed, as a process prior to finishing milling, i.e., final rolling, the product from the previous step may be subjected to cold rolling at a working ratio of 30-90%, and then intermediate heat treating at a temperature of 550-700° C. for 10-100 seconds (cold rolling and intermediate heat treatment step). Such step is applicable if there is a great difference between a thickness of a product after precipitation heat treatment and a thickness of the product after final rolling and the product exceeds ranges of target physical properties (strength and electrical conductivity) or it is difficult to acquire target characteristics (bendability), and is executable so as to solve surface quality problems, such as burning (partial bonding due to heat and pressure) which may be generated due to a process or preparation conditions of field precipitation heat treatment equipment, scratches generated due to a pickling process after precipitation heat treatment, etc. Here, since the main purpose of intermediate heat treatment is to reduce strength but reduction in electrical conductivity must be minimized, it is important to execute annealing so as to reduce electrical conductivity by 0.5-3% IACS. If electrical conductivity is reduced by a value of less than 0.5% IACS, annealing has no effect, and if electrical conductivity is reduced by a value exceeding 3% IACS, annealing has great effects but there is a possibility that the copper alloy deviates from target characteristics due to reduction in electrical conductivity and strength thereof.

Finally, the obtained product from the previous step is subjected to cold rolling at a working ratio of 10-70% to acquire a final product of the copper alloy strip (final cold rolling step). Generally, in such step, physical properties of the copper alloy strip, such as strength and bendability, may be finally determined. In general, through a cold rolling process, for example, strength of a material is increased and bendability and conductivity of the material are reduced. Therefore, rolling conditions to increase strength and to decrease reduction in bendability and conductivity are required. The working ratio may be within a range of 20-50%, and in this range, efficiency in strength increase according to the working ratio is maximized and proper balance among strength, bendability and conductivity may be achieved.

In general, strength and electrical conductivity of a copper alloy material conflict with each other, i.e., are inversely proportional to each other, and thus, it is difficult to simultaneously achieve the same. Nevertheless, the copper alloy strip in accordance with the present invention has tensile strength of 370-600 MPa and secures bendability having an R/t ratio of 1.0 or less at which no cracks occur when the copper alloy strip is bent at an angle of 90°. Further, in order to prepare a copper alloy strip requiring excellent bendability, precipitation heat treatment conditions may be adjusted as described above, so as to secure bendability having an R/t ratio of 0.5 or less.

The copper alloy strip in accordance with the present invention forms various precipitates according to component elements thereof. In the copper alloy strip in accordance with the present invention, Cr, Co, Si, Mg and Sn generate precipitates independently or combinedly, and these precipitates improve a softening resistant temperature and reduce elements forming a solid solution in a matrix and may thus improve conductivity and increase thermal conductivity.

Hereinafter, the present invention will be described with reference to Examples.

Examples

Table 1 below states compositions of copper alloy strips in accordance with the present invention. Specimens of the copper alloy strips having the compositions stated in Table 1 will be acquired as below.

TABLE 1

| | Cu | Cr | Co | Si | Mg | Sn |
|---|---|---|---|---|---|---|
| Example 1 | Balance | 0.30 | 0.01 | — | — | — |
| Example 2 | Balance | 0.30 | 0.05 | — | — | — |
| Example 3 | Balance | 0.30 | 0.10 | — | — | — |
| Example 4 | Balance | 0.30 | 0.15 | — | — | — |
| Example 5 | Balance | 0.20 | 0.05 | — | — | — |
| Example 6 | Balance | 0.40 | 0.05 | — | — | — |
| Example 7 | Balance | 0.30 | 0.01 | 0.05 | — | — |
| Example 8 | Balance | 0.30 | 0.01 | — | 0.05 | — |
| Example 9 | Balance | 0.30 | 0.01 | — | — | 0.05 |
| Example 10 | Balance | 0.30 | 0.05 | 0.05 | — | — |
| Example 11 | Balance | 0.30 | 0.05 | 0.05 | — | — |
| Example 12 | Balance | 0.30 | 0.05 | — | 0.05 | — |
| Example 13 | Balance | 0.30 | 0.05 | — | — | 0.05 |
| Example 14 | Balance | 0.30 | 0.10 | 0.05 | — | — |
| Example 15 | Balance | 0.30 | 0.10 | — | 0.05 | — |
| Example 16 | Balance | 0.30 | 0.10 | — | — | 0.05 |
| Example 17 | Balance | 0.30 | 0.05 | 0.02 | — | — |
| Example 18 | Balance | 0.30 | 0.05 | — | 0.02 | — |
| Example 19 | Balance | 0.30 | 0.05 | — | — | 0.02 |
| Example 20 | Balance | 0.30 | 0.05 | 0.15 | — | — |
| Example 21 | Balance | 0.30 | 0.05 | — | 0.15 | — |
| Example 22 | Balance | 0.30 | 0.05 | — | — | 0.15 |
| Example 23 | Balance | 0.20 | 0.05 | 0.05 | — | — |
| Example 24 | Balance | 0.40 | 0.05 | 0.05 | — | — |
| Example 25 | Balance | 0.30 | 0.05 | 0.02 | 0.02 | — |
| Example 26 | Balance | 0.30 | 0.05 | 0.02 | 0.02 | 0.02 |
| Comparative example 1 | Balance | 0.30 | — | — | — | — |
| Comparative example 2 | Balance | 0.10 | 0.05 | — | — | — |
| Comparative example 3 | Balance | 0.45 | 0.05 | — | — | — |
| Comparative example 4 | Balance | 0.30 | 0.20 | — | — | — |
| Comparative example 5 | Balance | 0.30 | 0.05 | 0.2 | — | — |
| Comparative example 6 | Balance | 0.30 | 0.05 | — | 0.2 | — |
| Comparative example 7 | Balance | 0.30 | 0.05 | — | — | 0.2 |

Alloy elements including copper were mixed according to each of the compositions stated in Table 1 per 1 kg, an acquired mixture was melted in a high frequency melting furnace and then an ingot having a thickness of 20 mm, a width of 50 mm and a length of 110-120 mm was manufactured (melting and casting step). Here, as a Cr component, in order to minimize reduction in the Cr content due to oxidation, a Cu master alloy including 10% by mass of Cr was used. In order to remove bad parts, such as rapidly cooled parts and shrinkage cavities, bottom and top portions of the manufactured ingot were respectively cut off by lengths of 10 mm and 20 mm and then the ingot was subjected to homogenization heat treatment in a box furnace at a temperature of 850-1,000° C. for 2 hours (homogenization heat treatment step), and hot rolling at a working ratio of 50% (hot rolling step). The obtained product from the previous step was subjected to water quenching, simultaneously with completion of hot rolling, to solution treat (solution treatment step). Oxide scales generated on the surface of a material after hot rolling were removed using a milling machine, and then, precipitation driving force was increased through cold rolling at a working ratio of 94% (cold rolling step). A specimen of Example 10 was prepared by additionally executing cold rolling and intermediate heat treatment step, and in this case, precipitation driving force was increased through cold rolling at a working ratio of 89% (cold rolling step).

Thereafter, the obtained product from the previous step was subjected to precipitation heat treatment at temperatures of 450° C. and 500° C. for 3 hours, respectively, using a box furnace (precipitation heat treatment step).

In Example 10 in which the specimen was prepared by additionally executing cold rolling and intermediate heat treatment prior to final rolling, the product from the previous step was subjected to cold rolling at a working ratio of 64% after precipitation heat treatment step and then intermediate heat treatment at a temperature of 650° C. for 30 seconds (cold rolling and intermediate heat treatment step). Here, reduced electrical conductivity was 0.6% IACS. In Example 11 having the same composition, cold rolling and intermediate heat treatment step was omitted.

Finally, the acquired product was subjected to cold rolling at a working ratio of 30% so that a finished product may secure target physical properties (final cold rolling step).

In Table 1 above, the specimens of Examples 1 to 6 were Cu—Cr—Co-based alloys excluding the additive element group (Si, Mg and Sn) and represented upper and lower limits of the Co content. The specimens of Examples 7 to 26 were Cu—Cr—Co-based alloys including the additive element group (Si, Mg and Sn), and the specimens of Examples 17 to 22 represented an upper limit of the additive element group. The specimens of Examples 23 and 24 represented upper and lower limits of the Cr content, and the specimens of Examples 25 and 26 exhibited effects of combinations of the elements of the additive element group (Si, Mg and Sn).

The specimen of Comparative Example 1 was a Cu—Cr-based alloy excluding Co, the specimens of Comparative Examples 2 and 3 respectively represented a value of less than the lower limit of the Cr content and a value exceeding the upper limit of the Cr content, and the specimens of Comparative Examples 4 to 7 included Co and the additive element group, contents of which exceeded upper limits thereof.

Tables 2 and 3 below represented results of measurement of physical properties of the copper alloy strip specimens prepared according to Examples of Table 1.

Hereinafter, a characteristic (physical property) analysis method of the copper alloy strip specimens will be described. Characteristic analysis of the copper alloy strip specimens was executed for specimens, cold rolling of which was executed at a working ratio of 30% after precipitation heat treatment, analysis results of the specimens, precipitation heat treatment of which was executed at a temperature of 450° C. for 3 hours, were represented in Table 2, and analysis results of the specimens, precipitation heat treatment of which was executed at a temperature of 500° C. for 3 hours, were represented in Table 3.

Hardness was measured by applying a load of 1 kg using a Vickers hardness tester TUKON 2500 from INSTRON Co., Ltd., tensile strength was measured using a universal testing machine Z100 from ZWICK ROELL GmbH, and electrical conductivity was measured using SIGMATEST 2.069 from FOERSTER GmbH.

In softening resistant temperature analysis, heat treatment was executed using a Thermolyne 5.8 L D1 Benchtop Muffle Furnace from THERMO SCIENTIFIC Co., Ltd. After heat treatment of the specimens was executed respectively at temperatures of 300, 350, 400, 450, 500, 550, 600, 650 and 700° C. for 30 minutes, hardness values of the specimens were measured, a graph of a broken line in which the Y-axis represented hardness and the X-axis represents temperature was drawn, and a temperature value intersecting a point corresponding to 80% of an initial hardness value was calculated as a softening resistant temperature. In this regard, the copper alloy strip specimen of Example 9 (shown as "alloy in the invention" in FIG. 1) was exemplarily compared to conventional copper alloys, in FIG. 1.

Bendability was evaluated by observing the specimen having a thickness of 0.3 mm bent at an angle of 90° in a direction horizontal to a rolling direction and then calculating a minimum bending radius/strip thickness (R/t) ratio. The minimum bending radius R was a radius R value of an edge of a right angle part of a bending test fixture, fixtures respectively having R values of 0.00, 0.05, 0.75, 0.10, 0.15, 0.20, 0.25, 0.30, 0.40 and 0.50 were used, and evaluation of bendability was carried out by selecting a maximum R/t ratio in which no cracks occur, when the specimen was observed using a microscope at 50× magnifications.

Thermal conductivity was analyzed using LFA 457 MicroFlash from NETZSCH GmbH, and the Lorenz number L of the copper alloy strip specimen of Example was calculated by comparatively analyzing a measured thermal conductivity value and an electrical conductivity value measured using SIGMATEST, and a constant range thereof was deduced.

The deduced constant range was proposed as a Lorenz number value range of the copper alloy strip in accordance with the present invention, in the mathematical expression representing the relationship between thermal conductivity and electrical conductivity according to the Wiedemann-Franz law, and the Lorenz number was $2.24(\pm0.02)\times10^{-8}$ $W\Omega K^{-2}$, i.e., $2.24(\pm0.02)\times0.00000001$ $W\Omega K^{-2}$, and a reliability range thereof was about ±0.9%, as described above.

Table 2 represented results of measurement of characteristics of the specimens, final rolling of which was executed at a working ratio of 30% after precipitation heat treatment executed at a temperature of 450° C. for 3 hours.

TABLE 2

| | Precipitation conditions ° C. × hr | Hardness Hv | Tensile strength MPa | Electrical conductivity % IACS | Softening resistant temp. ° C. | Bendability (R/t) | Thermal conductivity W/m · K | L number $\times10^{-8}W\Omega K^{-2}$ |
|---|---|---|---|---|---|---|---|---|
| Example 1 | 450 × 3H | 136 | 431 | 88 | 455 | 0.00 | 338 | 2.259 |
| Example 2 | 450 × 3H | 140 | 461 | 84 | 475 | 0.17 | 321 | 2.248 |

TABLE 2-continued

| | Precipitation conditions ° C. × hr | Hardness Hv | Tensile strength MPa | Electrical conductivity % IACS | Softening resistant temp. ° C. | Bendability (R/t) | Thermal conductivity W/m · K | L number $\times 10^{-8}$WΩ $K^{-2}$ |
|---|---|---|---|---|---|---|---|---|
| Example 3 | 450 × 3H | 160 | 490 | 80 | 490 | 0.25 | 305 | 2.242 |
| Example 4 | 450 × 3H | 172 | 510 | 75 | 495 | 0.50 | 284 | 2.227 |
| Example 5 | 450 × 3H | 139 | 441 | 84 | 475 | 0.17 | 321 | 2.248 |
| Example 6 | 450 × 3H | 156 | 470 | 83 | 480 | 0.17 | 316 | 2.239 |
| Example 7 | 450 × 3H | 152 | 461 | 86 | 475 | 0.17 | 329 | 2.250 |
| Example 8 | 450 × 3H | 158 | 470 | 86 | 480 | 0.17 | 329 | 2.250 |
| Example 9 | 450 × 3H | 155 | 470 | 85 | 470 | 0.17 | 325 | 2.249 |
| Example 10 | 450 × 3H | 170 | 535 | 81 | 520 | 0.25 | 310 | 2.251 |
| Example 11 | 450 × 3H | 166 | 539 | 82 | 520 | 0.25 | 312 | 2.238 |
| Example 12 | 450 × 3H | 162 | 529 | 83 | 520 | 0.25 | 316 | 2.239 |
| Example 13 | 450 × 3H | 169 | 559 | 81 | 510 | 0.50 | 307 | 2.229 |
| Example 14 | 450 × 3H | 172 | 578 | 79 | 535 | 0.33 | 300 | 2.233 |
| Example 15 | 450 × 3H | 175 | 588 | 80 | 525 | 0.33 | 303 | 2.228 |
| Example 16 | 450 × 3H | 172 | 578 | 77 | 530 | 0.67 | 292 | 2.230 |
| Example 17 | 450 × 3H | 145 | 441 | 85 | 485 | 0.17 | 325 | 2.249 |
| Example 18 | 450 × 3H | 147 | 451 | 84 | 485 | 0.17 | 321 | 2.248 |
| Example 19 | 450 × 3H | 146 | 451 | 83 | 480 | 0.17 | 318 | 2.253 |
| Example 20 | 450 × 3H | 175 | 598 | 75 | 530 | 0.50 | 285 | 2.235 |
| Example 21 | 450 × 3H | 176 | 598 | 80 | 525 | 0.50 | 302 | 2.220 |
| Example 22 | 450 × 3H | 177 | 588 | 78 | 520 | 0.83 | 295 | 2.224 |
| Example 23 | 450 × 3H | 163 | 510 | 85 | 510 | 0.25 | 325 | 2.249 |
| Example 24 | 450 × 3H | 178 | 588 | 84 | 530 | 0.33 | 320 | 2.241 |
| Example 25 | 450 × 3H | 178 | 585 | 85 | 525 | 0.33 | 323 | 2.235 |
| Example 26 | 450 × 3H | 177 | 595 | 83 | 530 | 0.50 | 314 | 2.225 |
| Comparative example 1 | 450 × 3H | 125 | 392 | 94 | 430 | 0.00 | 360 | — |
| Comparative example 2 | 450 × 3H | 130 | 412 | 85 | 440 | 0.17 | 325 | — |
| Comparative example 3 | 450 × 3H | 158 | 480 | 82 | 480 | 0.33 | 312 | — |
| Comparative example 4 | 450 × 3H | 149 | 490 | 71 | 500 | 1.00 | 269 | — |
| Comparative example 5 | 450 × 3H | 158 | 510 | 56 | 520 | 1.33 | 214 | — |
| Comparative example 6 | 450 × 3H | 183 | 627 | 75 | 535 | 1.33 | 284 | — |
| Comparative example 7 | 450 × 3H | 180 | 588 | 73 | 525 | 1.67 | 276 | — |

Table 3 represented resulted of measurement of characteristics of the specimens, final rolling of which was executed at a working ratio of 30% after precipitation heat treatment executed at a temperature of 500° C. for 3 hours.

TABLE 3

| | Precipitation conditions ° C. × hr | Hardness Hv | Tensile strength MPa | Electrical conductivity % IACS | Softening resistant temp. ° C. | Bendability (R/t) | Thermal conductivity W/m · K | L number $\times 10^{-8}$WΩ $K^{-2}$ |
|---|---|---|---|---|---|---|---|---|
| Example 1 | 500 × 3H | 120 | 372 | 91 | 450 | 0.00 | 348 | 2.249 |
| Example 2 | 500 × 3H | 122 | 392 | 87 | 455 | 0.00 | 333 | 2.251 |
| Example 3 | 500 × 3H | 148 | 470 | 82 | 485 | 0.17 | 312 | 2.238 |
| Example 4 | 500 × 3H | 155 | 490 | 79 | 485 | 0.17 | 301 | 2.241 |
| Example 5 | 500 × 3H | 120 | 382 | 87 | 450 | 0.00 | 333 | 2.251 |
| Example 6 | 500 × 3H | 134 | 431 | 86 | 470 | 0.00 | 328 | 2.243 |
| Example 7 | 500 × 3H | 135 | 421 | 87 | 460 | 0.00 | 333 | 2.251 |
| Example 8 | 500 × 3H | 137 | 441 | 88 | 460 | 0.00 | 337 | 2.252 |
| Example 9 | 500 × 3H | 132 | 412 | 87 | 450 | 0.17 | 333 | 2.251 |
| Example 10 | 500 × 3H | 137 | 450 | 84 | 500 | 0.17 | 320 | 2.241 |
| Example 11 | 500 × 3H | 135 | 441 | 85 | 505 | 0.17 | 324 | 2.242 |
| Example 12 | 500 × 3H | 155 | 500 | 85 | 505 | 0.17 | 324 | 2.242 |
| Example 13 | 500 × 3H | 145 | 470 | 84 | 495 | 0.33 | 319 | 2.234 |
| Example 14 | 500 × 3H | 156 | 510 | 82 | 520 | 0.17 | 311 | 2.231 |
| Example 15 | 500 × 3H | 158 | 519 | 83 | 510 | 0.17 | 315 | 2.232 |
| Example 16 | 500 × 3H | 155 | 510 | 80 | 505 | 0.50 | 303 | 2.228 |
| Example 17 | 500 × 3H | 130 | 402 | 88 | 465 | 0.00 | 337 | 2.252 |
| Example 18 | 500 × 3H | 135 | 431 | 89 | 460 | 0.00 | 340 | 2.247 |
| Example 19 | 500 × 3H | 136 | 441 | 87 | 460 | 0.17 | 333 | 2.251 |
| Example 20 | 500 × 3H | 140 | 461 | 87 | 515 | 0.33 | 302 | 2.220 |
| Example 21 | 500 × 3H | 165 | 529 | 83 | 515 | 0.33 | 314 | 2.225 |
| Example 22 | 500 × 3H | 151 | 490 | 82 | 505 | 0.50 | 310 | 2.223 |
| Example 23 | 500 × 3H | 130 | 441 | 87 | 500 | 0.00 | 333 | 2.251 |

TABLE 3-continued

| | Precipitation conditions ° C. × hr | Hardness Hv | Tensile strength MPa | Electrical conductivity % IACS | Softening resistant temp. ° C. | Bendability (R/t) | Thermal conductivity W/m · K | L number $\times 10^{-8}$ WΩ $K^{-2}$ |
|---|---|---|---|---|---|---|---|---|
| Example 24 | 500 × 3H | 155 | 510 | 86 | 510 | 0.17 | 328 | 2.243 |
| Example 25 | 500 × 3H | 162 | 518 | 87 | 515 | 0.17 | 331 | 2.238 |
| Example 26 | 500 × 3H | 168 | 530 | 86 | 520 | 0.17 | 325 | 2.223 |
| Comparative example 1 | 500 × 3H | 112 | 343 | 96 | 420 | 0.00 | 367 | — |
| Comparative example 2 | 500 × 3H | 117 | 353 | 88 | 425 | 0.00 | 337 | — |
| Comparative example 3 | 500 × 3H | 136 | 438 | 86 | 470 | 0.25 | 328 | — |
| Comparative example 4 | 500 × 3H | 135 | 451 | 74 | 470 | 0.50 | 280 | — |
| Comparative example 5 | 500 × 3H | 164 | 519 | 74 | 520 | 0.67 | 281 | — |
| Comparative example 6 | 500 × 3H | 168 | 549 | 80 | 520 | 0.67 | 303 | — |
| Comparative example 7 | 500 × 3H | 165 | 519 | 78 | 510 | 0.83 | 294 | — |

As known from above Examples, the copper alloy strip in accordance with the present invention was judged as a material not only having both excellent softening resistance and thermal conductivity, as compared to conventional alloy materials, but also having excellent strength and bendability. In regard to the specimens of Comparative Examples, the specimen of Comparative example 1, which was a Cu—Co-based alloy strip excluding Co, did not satisfy softening resistance. The specimen of Comparative Example 2 including Cr, the content of which was less than the lower limit, was insufficient in softening resistance, the specimen of Comparative Example 3 including Cr, the content of which exceeded the upper limit thereof, exhibits no improvement in characteristics and further reduced bendability, as compared to the specimen of Example 6 including the upper limit of the Cr content. The specimens of Comparative Examples 4 to 7 which were copper alloy strips including Co and the additive element group, the contents of which exceeded upper limits thereof, satisfied softening resistance but had insufficient bendability and thermal conductivity.

The relationship between thermal conductivity and electrical conductivity of the copper alloy strip specimens of Examples 1 to 26 in accordance with the present invention satisfied the above-described range of the Lorenz number which was $2.24(\pm 0.02)\times 10^{-8}$ WΩ$K^{-2}$, and according to the above-described preparation method, a copper alloy strip satisfying an R/t ratio of 1.0 or less at which no cracks occurred when the copper alloy strip was bent at an angle of 90°, particularly of 0.5 or less, was prepared.

In order to observe precipitates in the copper alloy strip in accordance with the present invention, TEM analysis was executed by a replica method.

Figure 2:
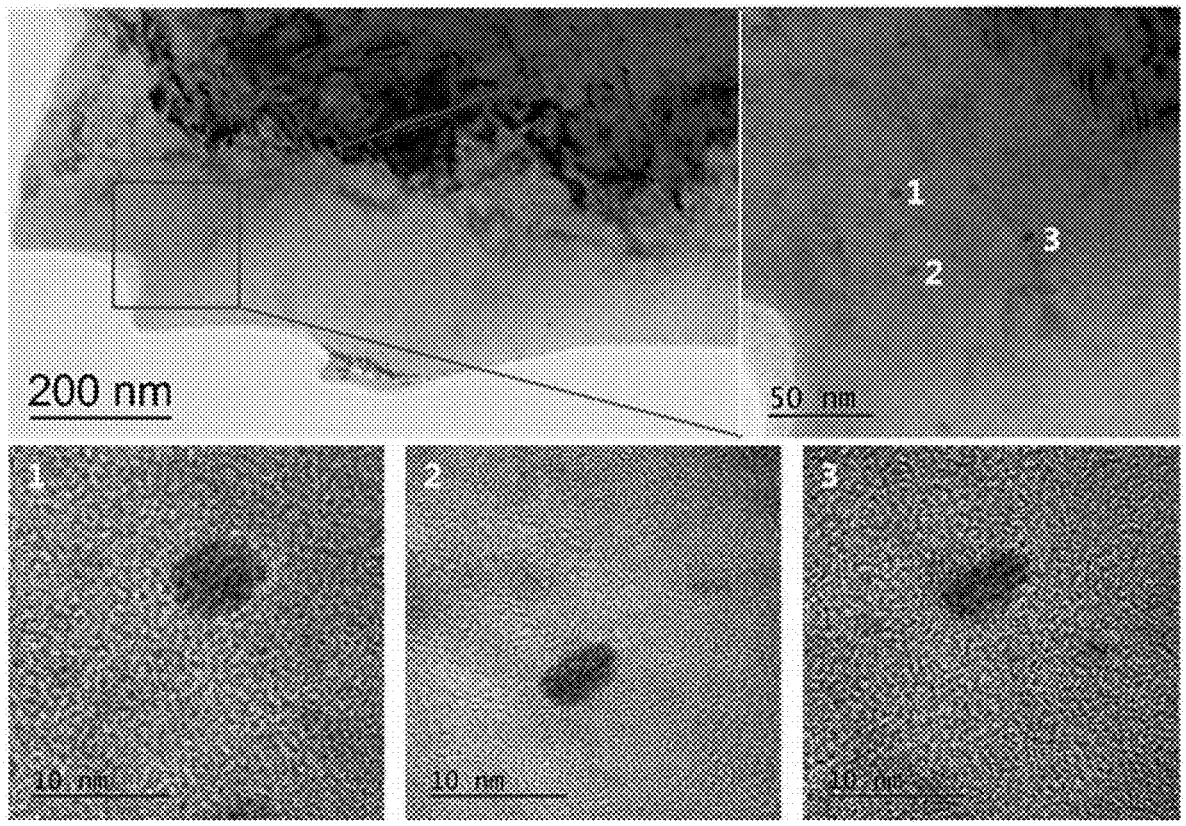
FIG. 2 is TEM photographs representing fine cobalt precipitates having an average size of 10 nm or less in a specimen of a copper alloy strip in accordance with the present invention (Example 2).

In the copper alloy strip in accordance with the present invention, if a cobalt component independently formed precipitates, the precipitates having an average size of 10 nm or less were very fine and could not be observed using a scanning electron microscope (SEM) or an optical microscope. For example, FIG. 2 was a TEM photograph of the copper alloy strip specimen of Example 2. As shown from FIG. 2, cobalt particles were observed as very fine precipitates and it was confirmed that, if cobalt independently formed precipitates, the precipitates had very fine sizes.

Figure 3:
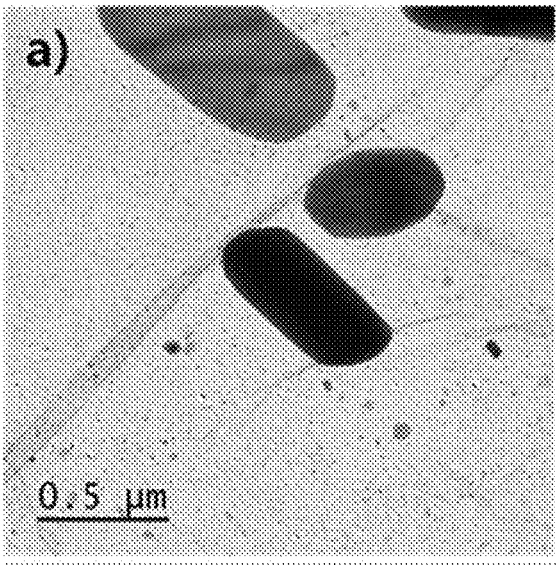
FIG. 3 shows TEM photographs representing precipitates in the specimen of the copper alloy strip in accordance with the present invention (Example 11), and particularly, in FIG. 3, a) represents the shape and composition of a coarse precipitate including about 1% by mass of cobalt in a $Cr_3Si$ compound and having a size of about 500 nm, and b) represents the shape and composition of a fine precipitate including about 10% by mass of cobalt in the $Cr_3Si$ compound and having a comparatively small size of 200 nm or less.
Figure 3:
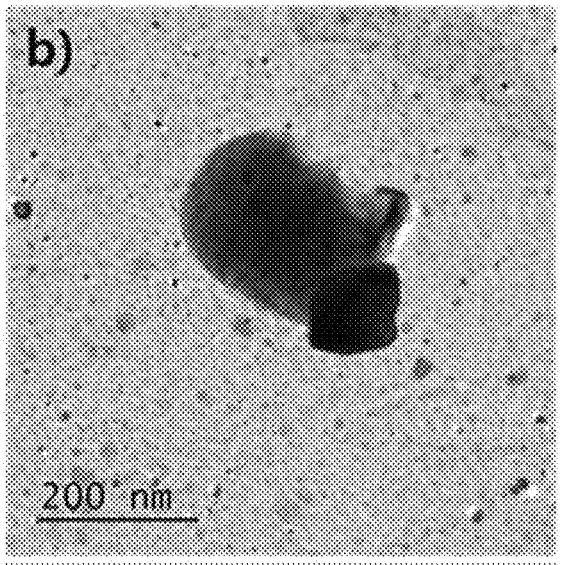

In the copper alloy strip in accordance with the present invention, if at least one selected from the above-described additive element group was added, an additive element was combined with chrome and cobalt, and thus formed precipitates. For example, FIG. 3 showed TEM photographs representing precipitates in the copper alloy strip specimen of Example 11 in which silicon was added. With reference to a) of FIG. 3, a precipitate having a relatively large size of 500 nm or more were observed as a precipitate including about 1% by mass of cobalt in a Cr3Si compound. Further, a precipitate having a relatively small size of 200 nm or less were observed as a precipitate including about 10% by mass of cobalt in the Cr3Si compound (in b) of FIG. 3). Thereby, it might be confirmed that, as the size of a precipitate was decreased, and the Co content was increased. Judging from mechanical and physical properties of the additive element group and thermodynamic relations with chrome and cobalt, if other elements rather than silicon were added, the same results as addition of silicon shown in b) of FIG. 3 were predicted.

What is claimed is:

1. A copper alloy strip for electrical and electronic parts consisting of:

0.20-0.40% by mass of chrome (Cr), 0.01-0.15% by mass of cobalt (Co), and the balance of copper (Cu) and inevitable impurities, and optionally 0.00-0.15% by mass, in total, of at least one selected from the additive element group consisting of silicon (Si), magnesium (Mg) and tin (Sn), wherein the copper alloy strip has a softening resistant temperature of 450° C. or higher and thermal conductivity of 280 W/m·K or more, wherein an R/t ratio of the copper alloy strip at which no cracks occur during bending at an angle of 90° is 1.0 or less;

wherein the copper alloy strip is prepared by the following steps, comprising:

melting elements based on the composition of the copper alloy strip in a melting furnace to cast an ingot;

homogenization heat treating the acquired ingot at a temperature of 850-1,000° C. for 1-4 hours;

hot rolling the obtained product from the previous step at a working ratio of 40-95%;

water quenching the obtained product from the previous step simultaneously with completion of the hot rolling to solution treat at a material surface treatment of 600° C. or higher;

cold rolling the obtained product from the previous step at a working ratio of 87-98%;

precipitation heat treating the obtained product from the previous step at a temperature of 430-520° C. for 1-10 hours; and final cold rolling the obtained product from the previous step at a working ratio of 10-70% to produce a finished product of the copper alloy strip, wherein an R/t ratio of the finished product of the copper alloy strip at which no cracks occur during bending at an angle of 90° is 1.0 or less.

2. The copper alloy strip for electrical and electronic parts according to claim 1, wherein a cobalt content is in a range of 0.05-0.15% by mass.

3. The copper alloy strip for electrical and electronic parts according to claim 1, wherein a total content of the at least one selected from the additive element group is in a range of 0.05-0.15% by mass.

4. The copper alloy strip for electrical and electronic parts according to claim 1, wherein the softening resistant temperature of the copper alloy strip is 500° C. or higher.

5. The copper alloy strip for electrical and electronic parts according to claim 1, wherein the thermal conductivity of the copper alloy strip is 300 W/m·K or more.

6. The copper alloy strip for electrical and electronic parts according to claim 1, wherein the R/t ratio of the copper alloy strip at which no cracks occur during bending at the angle of 90° is 0.5 or less.

7. The copper alloy strip for electrical and electronic parts according to claim 1, wherein relations between thermal conductivity $\kappa$ and electrical conductivity $\sigma$ of the copper alloy strip satisfy Equation $\kappa=2.24(\pm0.02)\times10^{-8}$ [$W\Omega K^{-2}$]$\times\sigma$ [$1/\Omega m$]$\times293.15$ [K].

* * * * *